US006196108B1

(12) United States Patent
Murello

(10) Patent No.: US 6,196,108 B1
(45) Date of Patent: Mar. 6, 2001

(54) DAMPED SPRING MECHANISM FOR A FIREARM

(75) Inventor: Johannes Murello, Rottweil (DE)

(73) Assignee: Heckler & Koch GmbH, Obendorf/Neckar (DE)

( * ) Notice: Subject to any disclaimer, the term of this patent is extended or adjusted under 35 U.S.C. 154(b) by 0 days.

(21) Appl. No.: 09/173,832

(22) Filed: Oct. 16, 1998

(30) Foreign Application Priority Data

Oct. 22, 1997 (DE) ..... 197 46 643

(51) Int. Cl.[7] ..... F41A 25/10

(52) U.S. Cl. ..... 89/44.02; 89/198; 89/37.04; 89/37.14

(58) Field of Search ..... 89/44.02, 198, 89/37.04, 37.14, 165

(56) References Cited

U.S. PATENT DOCUMENTS 168,346 * 10/1875 Schultz ..... 89/44.02
2,381,130 * 8/1945 Lloyd ..... 89/37.04
3,225,656 * 12/1965 Flaherty et al. ..... 89/37.04
5,076,139 * 12/1991 Hiett ..... 89/198

FOREIGN PATENT DOCUMENTS

520929 * 5/1940 (GB) ..... 89/44.02
521272 * 5/1940 (GB) ..... 89/44.02

* cited by examiner

*Primary Examiner*—Stephen M. Johnson
(74) *Attorney, Agent, or Firm*—Marshall, O'Toole, Gerstein, Murray & Borun

(57) ABSTRACT

A damped spring device for a firearm is disclosed. The damped spring device includes a housing, a cylindrical outer tube fixed to the housing and defining a cavity, and a cylindrical barrel slidably disposed within the outer tube cavity such that the outer tube and the barrel define therebetween an annular space. The barrel is moveable longitudinally through a portion of the cavity between a rest position and a recoil position in response to the firing of the firearm. A prestressed elastomeric spring is disposed within the annular space and operatively engages the outer tube and the barrel for biasing the barrel toward the rest position and for braking the relative movement between the barrel and the outer tube.

11 Claims, 1 Drawing Sheet

DAMPED SPRING MECHANISM FOR A FIREARM

FIELD OF THE INVENTION

The present invention relates generally to firearms, and more specifically, to a damped spring mechanism for a firearm.

BACKGROUND OF THE INVENTION

Many small arms, including most automatic weapons, have moveable component parts that move or recoil in response to the gas pressure produced by the firing of the weapon. A spring is typically provided in order to cushion the moveable component as it approaches a fully recoiled position, and also to return the moveable component to a rest position in preparation for firing the next round of ammunition. Generally speaking, the spring must have a relatively high pretension, relative to its spring constant, against the moveable component.

After the moveable component has moved to the fully recoiled position, the spring subsequently returns the moveable component in the opposite direction back to the rest position. The spring must exert enough force on the moveable component to quickly return it back to the rest position. In the process, the moveable component comes into contact with a stop or support which helps to define the rest position. The moveable component typically runs into the stop with a great deal of force, and thus ideally the spring must be strong enough so that the moveable component does not continue to vibrate significantly when it contacts the stop.

In the event the moveable component is not biased against the stop with enough force, such as when the force of the spring is low relative to its spring constant, it is then possible that the moveable component will continue to oscillate and vibrate after coming into contact with the stop. In such a situation, the moveable component will experience a relatively significant time delay before it resumes the rest position. During this period of delay, the position of the moveable component relative to the rest of the weapon is undefined, which can cause functional disturbances such as weapon failure. Accordingly, damping mechanisms have been developed.

A good example of a prior art damping mechanism is the well known FN-Browning automatic shotgun which appeared on the market around the turn of the century. The FN-Browning has gained extraordinarily extensive use and has been employed by many hunters since its introduction. The barrel has its own recoil spring that is fully independent of the locking spring that triggers the reloading process and acts on the breech. This recoil spring is a coil spring arranged around the magazine tube, which is positioned beneath and parallel to the barrel. A sleeve mounted on the bottom of the barrel encloses the magazine tube and is biased by the recoil spring. A slotted brake ring is positioned between the magazine tube and recoil sleeve. The brake ring is pressed against the magazine tube by the force of the recoil spring, thus providing a braking action against the outer surface of the magazine tube. Continued vibration of the recoil spring is therefore strongly damped and no longer influences function of the weapon.

However, the damping effect is directly dependent on the force that the spring exerts on the barrel or sleeve. Therefore, the damping force is weakest precisely in the region of the rest position. Moreover, the FN-Browning brake is known to be very reliable, but only when the known shotgun is used under ordinary hunting conditions. A completely oil-free magazine tube already leads to load inhibitions because of the dry friction that results and thus the high braking effect. Use under conditions involving sand or mud exposure (rare in hunting weapons, common in military weapons) is inconceivable.

Another well known prior art damping mechanism involves the use of oil dampers. Oil dampers are similar to the shock absorbers used in vehicles and, like automotive shock absorbers, oil dampers are insensitive to soiling. In principle, it would be reasonable to use appropriately dimensioned oil dampers in a small firearm in which continued vibration of a weapon part is to be avoided. However, the weight, price and space requirements of such oil dampers are high. Moreover, such oil dampers require maintenance in order to ensure trouble-free operation. Finally, oil damped weapons are unsuitable for use as military weapons, which must be able to function flawlessly even after years of storage in an arsenal without major maintenance or reconditioning.

A final manner of achieving adequate damping is to use a cushion of exhaust gas in order to delay the striking of the moveable weapon part against the stop or support. Unfortunately, weapons so equipped are very susceptible to soiling, and typically experience a loss of firing accuracy. Thus, despite its advantages, such a mechanism is not well-suited for use in a sharpshooter's weapon or a weapon with similar requirements on firing precision.

The use of elastomer bodies in weapons has long been known. For example, the homemade shotguns that enjoy widespread use in the Philippines use rubber tension springs as striker springs. The PPSH 41 Russian submachine gun used an elastomer body on the end stop of the breech. Historically, such weapons have proven unsatisfactory due to the fact that the elastomer element gradually degrades with use and does not withstand aggressive weapon lubricant and cleaning agents over the long term.

Some chemically resistant elastomers have since been developed. However, the use of a pressure-loaded or preloaded elastomer body as recoil spring, instead of a steel compression spring, is not known, due in part to the fact that since previous applications of elastomers in small firearms have not been promising.

Elastomers have the inherent property of hysteresis, i.e., the energy expended for elastic deformation is not fully released on rebound. Instead, part of the kinetic energy is effectively consumed by being converted to heat energy, which manifests itself as heating of the elastomer body. Hysteresis is generally more pronounced under frequent pulse-like impact loads, such as the type of loads expected in a weapon. Significant energy consumption must therefore be reckoned with. Further, in principle an elastomer material is incompressible, just like a liquid, and thus the elastomer body requires space into which it will expand as the body yields under load. However, in the case of known elastomer buffers, the elastomer body is susceptible to destruction if deformed beyond its strength limits.

Accordingly, in addition to many other objects, features and advantages that will become readily apparent to those skilled in the art upon reading the following description, one of the objects of the present invention is to provide a simple, light, cost-effective, maintenance free and durable damped spring mechanism for a firearm, especially small firearms.

SUMMARY OF THE INVENTION

According to one aspect of the invention, a damped spring device for a firearm is provided. The damped spring device comprises a housing, a cylindrical outer tube fixed to the housing and defining a cavity, a cylindrical barrel slidably disposed within the outer tube cavity such that the outer tube and the barrel define therebetween an annular space with the barrel being moveable longitudinally through a portion of the cavity between a rest position and a recoil position, and a prestressed elastomeric spring disposed within the annular space and operatively engaging the outer tube and the barrel for biasing the barrel toward the rest position.

Preferably, the elastomeric spring includes a plurality of members, with each of the members being disposed adjacent to or stacked upon each other. Preferably, the elastomer spring is formed of a closed-pore elastomer. Also, the size of the annular space is adapted to change in response to movement of the barrel between the rest and recoil positions, and the elastomeric spring is preferably sized to substantially fill the annular space when the firearm is in the rest position. Alternatively, the cross-sectional dimension of the elastomer spring may initially be slightly less than the cross-sectional dimension of the annular space. In some embodiments, the barrel includes a cylindrical outer surface and the outer tube includes a cylindrical inner surface. In such embodiments, the barrel outer surface and the outer tube inner surface define the annular space.

According to another aspect of the invention, a damped spring device is adapted for use on a firearm having a stationary component and a moveable weapon part mounted for movement relative to the stationary component between a rest position and a recoil position. The damped spring device comprises a cylindrical outer tube fixed to the stationary component, and a cylindrical barrel mounted to the moveable weapon part and being slidably disposed within the outer tube. The outer tube and the barrel define therebetween an annular space. A prestressed elastomeric spring is disposed within the annular space and operatively engages the outer tube and the barrel. The elastomeric spring is adapted to bias the moveable weapon part toward the rest position and is further adapted to apply a braking force as the moveable weapon part approaches the rest position.

According to yet another aspect of the invention, a damped spring device for a firearm comprises an outer tube fixed to a housing. A barrel is mounted to a moveable weapon part, with the barrel being slidably disposed within the outer tube and being moveable between a rest position and a recoil position in response to the firing of the weapon. The outer tube and the barrel define therebetween an annular space, and the size of the annular space is adapted to shrink in response to movement of the barrel between the rest and recoil positions. An elastomeric spring is disposed within the annular space and operatively engages the outer tube and the barrel. A portion of the barrel is adapted to apply a prestress load to the elastomeric spring. The elastomeric spring is adapted to bias the moveable weapon part toward the rest position and further to apply a braking force as the moveable weapon part approaches the rest position.

These and other objects, features and advantages of the present invention will become readily apparent to those of skill in the art upon a reading of the following detailed description viewed in light of the accompanying drawings.

DETAILED DESCRIPTION OF THE INVENTION

Figure 1:
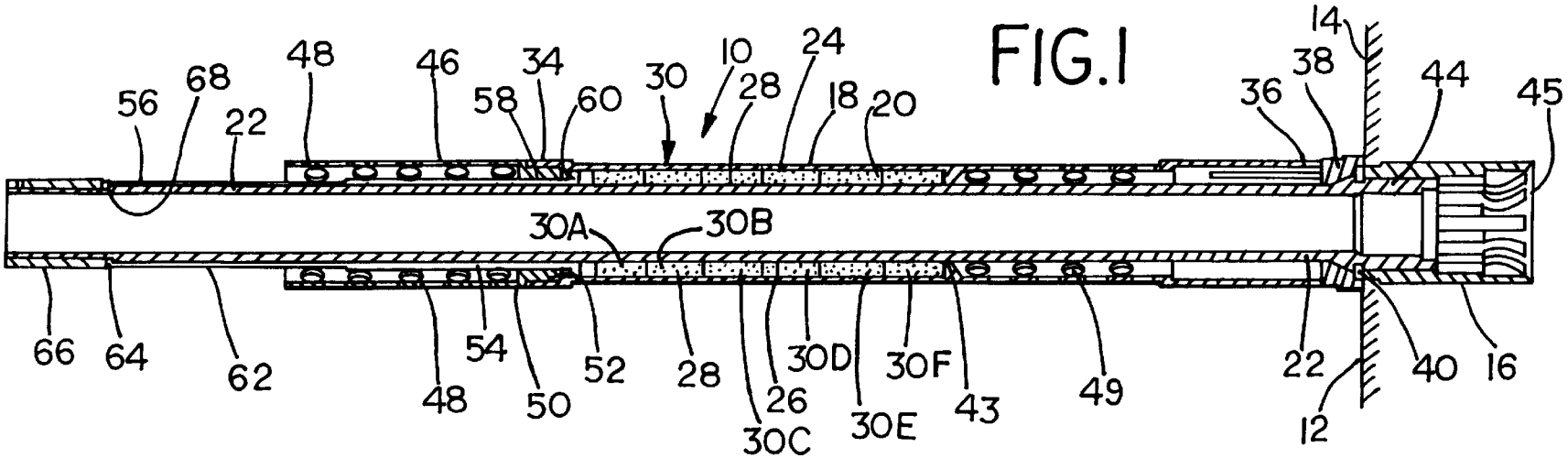
FIG. 1 is a cross-sectional view of a portion of a firearm incorporating a damped spring constructed in accordance with the teachings of the present invention and with the moveable weapon component being shown in a rest position.

Referring now to the drawings, a damped spring device assembled according to the teachings of the present invention is generally referred to by the reference numeral 10 and is shown installed on a firearm 12 having a stationary housing 14 and a moveable part 16. The bulk of the farm is conventional and thus is not shown. The moveable part 16 and the stationary housing 14 are adapted for relative movement in response to the firing of the firearm 12 in a manner well known to those of skill in the art, such that the moveable part 16 is moveable between the rest position shown in FIG. 1 and the recoil position shown in FIG. 2. An outer tube 18 is rigidly mounted to and fixed relative to the housing 14, and encloses a longitudinal cylindrical cavity 20. Typically, the outer tube 18 supports the bore near the muzzle and forms a hand protection.

A barrel 22 is slidably disposed within the cavity 20, such that an inner surface 24 of the outer tube 18 and an outer surface 26 of the barrel 22 define an annular space 28. The outer tube 18 and the barrel 22 are preferably constructed of corrosion resistant materials. Also, as stated above the outer tube 18 and the barrel 22 are generally cylindrical in shape and form therebetween a generally cylindrical annular space 28 which is bounded by two concentric walls. However, other shapes may be employed. The size of the annular space 28 changes as the moveable part 16 moves between the rest position and the recoil position.

An elastomeric spring 30 is disposed within and substantially fills the annular space 28. The elastomeric spring 30 preferably is comprised of a number of ring-shaped sections 30*a*, 30*b*, 30*c*, . . . etc. The precise number of sections 30*a*, 30*b*, 30*c*, etc. will depend on the dictates of the contemplated application, while the cross-sectional shape of each section preferably will roughly conform to the cross-sectional shape of the annular space 28. Preferably, each section 30*a*, 30*b*, 30*c*, etc., is constructed of a closed-cell polyurethane elastomer, such as the cellular polyurethane elastomer marketed by the BASF group under the trade name "Cellastoll" which is compressible to less than forty percent (40%) of its initial volume. Other elastomers having the required hysteresis, chemical resistance, and durability properties may be chosen. Ideally, the spring 30 will only increase the total weight and production price of the weapon 10 by the weight and production price of the elastomer spring 30.

The outer tube 18 includes a front end 34 and a rear end 36 having a stop 38. A buffer disk 40 lies within an annular seat 42 defined in the stop 38. The barrel 22 is mounted within the cavity 20 such that a rear end 44 of the barrel 22 protrudes past the rear end 36 of the outer tube 18. A locking member 45 is mounted to the rear end 44 of the barrel 22. The buffer disk 40 may alternately be attached to a portion of the barrel 22, the outer tube 18, or the locking member 45. The location of the stop 38 defines to forward most position of the barrel 22 relative to the outer tube 18.

The outer tube 18 preferably extends beyond the midpoint of the barrel 22 and includes an inwardly extending flange 43 located roughly adjacent the midsection of the outer tube 18. A guide bushing 46, which preferably includes a plurality of cooling holes 48, is concentrically threaded onto the forward end 34 of the outer tube 18. The guide bushing 46 is preferably aluminum, although other lightweight metals or alloys may also be employed. The guide bushing 46 includes a rear end 50 having an inwardly extending flange 52. A thin-walled piston 54 is mounted over a forward end 56 of the barrel 22. The piston 54 includes a rear end 58 having an outwardly extending collar or flange 60, and further includes a forward end 62 having an inwardly extending collar or flange 64.

The piston 54 is secured to the barrel 22 by a threaded locking collar or ring 66, which bears against the forward end 62 such that the flange 64 of the piston 54 contacts and is seated within an annular recess or seat 68 adjacent the forward end 56 of the barrel 22. As shown in FIG. 1, the flange 60 at the rear end 58 of the piston 54 abuts the flange 52 at the rear end 50 of the guide bushing 46. The piston 54 also includes an outer surface 70 which is sized to slide freely through an opening 72 defined by the flange 60 in the rear end 58 of the guide bushing 46. The flange 60 along with the stop 38 are fixed relative to the housing 14, and thus guarantee precise alignment of the barrel 22 when the moveable component 16 and the barrel 22 are in the rest position.

The elastomer spring assembly 30 is disposed within the annular space 28 such that a rear end 74 of the spring assembly 30 contacts the flange 45 extending inwardly from the outer tube 18, and further such that a forward end 76 of the spring assembly 30 contacts the flange 60 at the rear end of the piston 54. The spring assembly 30 is disposed such that it concentrically surrounds the barrel 22. The elastomer spring assembly 30 may be slightly prestressed by tightening the ring 66 on the forward end 56 of the barrel 22. As the ring 66 is tightened, the piston 54 is pushed rearwardly (i.e., to the right of the Figures), which thus forces the flange 60 of the piston 54 against the spring assembly 30, until the flange 64 at the forward end 62 of the piston 54 is drawn into contact with the recess or seat 68.

The elastomer spring assembly 30 substantially fills the annular space 28 between the outer tube 18 and the barrel 22, and extends between the flange 43 of the outer tube 18 and the flange 60 of the piston 54. The spring assembly 30 is not glued or otherwise joined to any of the surrounding walls. Moreover, the annular space 28 is substantially sealed, and thus no dirt or other contaminants can penetrate into the space. Preferably, each elastomer section 30*a*, 30*b*, 30*c*, etc. is constructed of fine-cell polyurethane. Thus, each section 30*a*, 30*b*, 30*c*, etc. is compressible due to the compressible cell volume of the polyurethane material. Such an elastomeric material will typically expand radially during axial compression. However, radial expansion is limited or prevented by providing surrounding walls.

Figure 2:
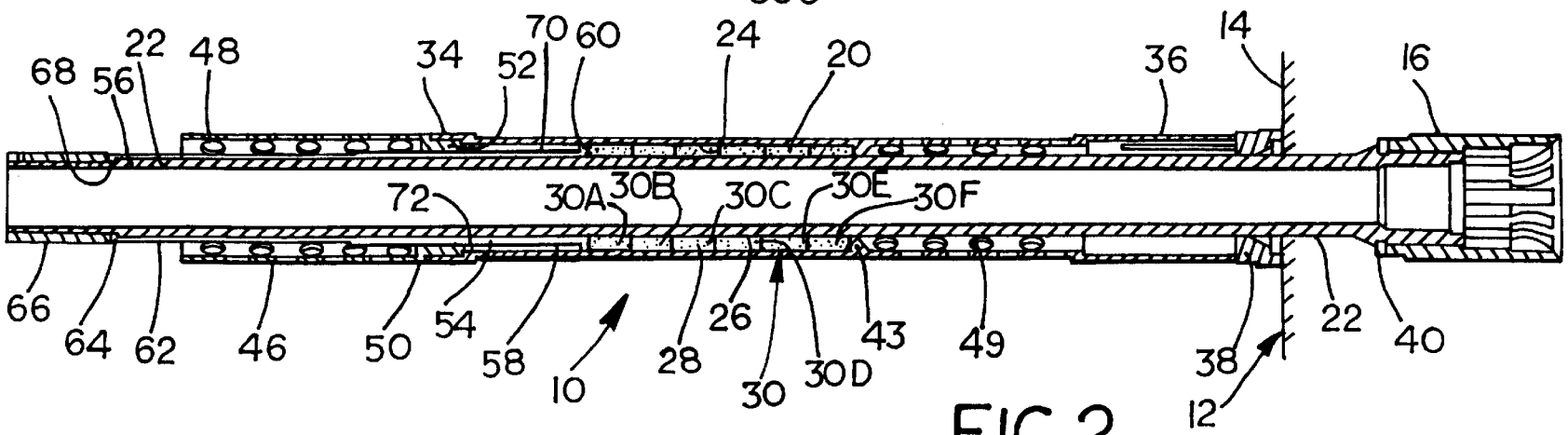
FIG. 2 is a cross-sectional view of the damped spring shown in FIG. 1 but illustrating the moveable weapon component moved away from the rest position toward a recoil position, such as in response to the firing of the firearm.

In operation, when a round of ammunition (not shown) is fired from the firearm 12, the moveable part 16 having the barrel 22 attached thereto moves or recoils from the rest position of FIG. 1 toward the recoil position of FIG. 2 in response to gas pressure produced by the fired round in a manner well known to those of skill in the art. The outer surface 26 of the barrel 22 moves relative to the outer tube 18 (i.e., to the right when viewing the Figures). When this happens, the piston 54, by virtue of its attachment to the barrel 22, also moves rearwardly effectively reducing the size of the annular space 28. Simultaneously, the flange 60 compresses the spring assembly 30, with the rear end of the spring assembly 30 being supported by the flange 43 as the spring assembly is compressed axially.

During the axial compression of the spring assembly 30, the elastomer material of each spring element 30*a*, 30*b*, 30*c*, etc., tries to expand radially. Consequently, the spring elements apply a direct braking force against the outer surface 26 of the barrel 22, slowing the movement of the barrel 22 relative to the outer tube 18. This braking force will be applied during recoil as well as when the barrel returns toward the rest position. Because the annular space 28 is effectively sealed, the detrimental effects of soiling of the area is prevented. Nevertheless, in the event the region is contaminated, such as by a grain of sand, the contaminant will be surrounded by the soft elastomeric material and thus will only slightly, if at all, alter the braking process.

The full recoil position of FIG. 2 may be determined by the extent of compression of the elastomer spring assembly 30. Alternatively, a separate stop (not shown) may be provided. After the recoiling force of the gasses have been expended, the spring assembly 30 expands again axially and biases the barrel 22 in a forward direction until it again reaches the rest position of FIG. 1. Because of the hysteresis of the elastomer material, however, the full recoil energy is not applied to the return of the barrel in the form of forward movement. Instead a significant part of the energy stored in the elastomer material is converted to heat (i.e., the elastomer material heats up), such that the barrel 22 slides gently forward in a damped fashion. Thus, a braking action is applied to the barrel 22 during rearward movement of the barrel due to the radial expansion of the elastomer sections 30*a*, 30*b*, 30*c*, etc. Additional braking and damping results due to expansion of the spring assembly within the annular space 28. This additional damping is particularly effective in avoiding vibration when the barrel 22 strikes the stop 38. The buffer disk 40 only prevents displacement of the stop 38. The cooling holes 48 in the guide bushing 46 along with cooling holes 49 in the outer tube 18 provide for rapid heat dissipation and also serve to reduce the weight of the firearm 12.

A distinct advantage of the present construction is that, after loosening the ring 66, either the barrel 22 may be removed from the outer tube 18 by drawing the barrel 22 rearwardly, or the outer tube 18 may be pulled off the barrel 22 by pulling the outer tube 18 forwardly. The piston 54, the guide housing 46, and the spring assembly 30 conveniently remain attached to the outer tube 18.

Persons of ordinary skill in the art will appreciate that, in addition to the position discussed about, the elastomeric spring 30 can be used in a small firearm anywhere the design length and volume occupied by the elastomer body can be accommodated without departing from the scope or spirit of the invention. For example, the spring 30 may be used as a locking spring of an automatic weapon in which the elastomer body is positioned in the rear shaft.

As will be further appreciated by those of skill in the art it is conceivable that an elastomer body may act like a damped spring mechanism without requiring a separate brake. Since the hysteresis properties can also depend on the shape of the elastomer body, it is preferable that the elastomer body be formed from elastomer elements supported one on the other. Preferably, the elastomer body will consist of a closed-pore, preferably fine-pore elastomer. It is also preferred that the elastomer body be enclosed within and substantially fill a surrounding cavity, which cavity becomes smaller in response to the firing of the weapon.

Because the gas enclosed in the pores is compressible, such a porous elastomer is also compressible as a function of pore volume. Because the elastomer body expands and fills the surrounding cavity as the cavity is compressed, the spring constant of the elastomer increases such that the elastomer body forms an end stop for the recoil movement, similar to a steel coil spring that is compressed so far that one thread sits on the other. Undesirable and harmful deformation of the elastomer body is simultaneously prevented.

When the elastomer body is compressed as the surrounding cavity shrinks, the surface of the elastomer body lying against the cavity walls is pressed against the wall, such as the surface of the barrel which is moving relative to the surrounding housing, and exerts a braking effect which increases as the elastomer body is compressed. The elastomer body therefore acts not only as a spring and as a hysteresis-conditioned damping element, but also as a mechanical braking element which is exposed to virtually no soiling, since it is active within the closed cavity.

It will be understood that the above description does not limit the invention to the above-given details. It is contemplated that various modifications and substitutions can be made without departing from the spirit and scope of the following claims.

What is claimed:

1. A firearm having a damped spring device, the firearm comprising:

a stationary component;

a cylindrical outer tube mounted to the stationary component;

a moveable weapon part slidably mounted to the stationary component and being moveable relative to the stationary component between a rest position and a recoil position;

a cylindrical barrel mounted to the moveable weapon part and being slidably disposed within the outer tube, the outer tube and the barrel defining therebetween an annular space, the annular space defining an internal volume that changes as the barrel moves in response to movement of the moveable weapon part between the rest and recoil positions;

a prestressed elastomeric spring disposed within the annular space and operatively engaging the outer tube and the barrel, the elastomeric spring being adapted to bias the moveable weapon part toward the rest position and further to apply a braking force as the moveable weapon part approaches the rest position, the elastomeric spring further being sized to substantially fill the annular space when the moveable weapon part is in the rest position.

2. The firearm of claim 1, wherein the elastomeric spring includes a plurality of elastomeric members, each of the members being disposed adjacent to at least one other member.

3. The firearm of claim 2, wherein the plurality of elastomeric members are aligned with each other.

4. The firearm of claim 2, wherein each of the elastomeric members is constructed of a closed-pore elastomer.

5. The firearm of claim 1, wherein the elastomer spring comprises a closed-pore elastomer.

6. The firearm of claim 1, wherein the barrel includes a cylindrical outer surface, and wherein the outer tube includes a cylindrical inner surface, the barrel outer surface and the outer tube inner surface defining the annular space.

7. A firearm having a damped spring device, the firearm comprising:

a stationary housing an outer tube mounted to the housing;

a moveable weapon part attached to the stationary housing, the moveable weapon part being moveable between a rest position and a recoil position in response to the firing of the firearm;

a barrel mounted to the moveable weapon part and being slidably disposed within the outer tube, the outer tube and the barrel defining therebetween an annular space, the size of the annular space being changeable as the barrel slides within the outer tube in response to movement of the moveable weapon part between the rest and recoil positions;

an elastomeric spring disposed within the annular space and operatively engaging the outer tube and the barrel, a portion of the barrel being adapted to apply a prestress load to the elastomeric spring, the elastomeric spring applying a biasing force to the barrel to thereby bias the moveable weapon part toward the rest position, the elastomeric spring further applying a braking force to the barrel as the moveable weapon part approaches the rest position.

8. The firearm of claim 7, wherein the elastomeric spring includes a plurality of aligned elastomeric members, each of the members being disposed adjacent to at least one other member.

9. The firearm of claim 7, wherein the elastomer spring comprises a closed-pore elastomer.

10. The firearm of claim 7, wherein the size of the cavity is adapted to change in response to movement of the barrel between the rest and recoil positions, and further wherein the elastomeric spring is sized to substantially fill the annular space.

11. The firearm of claim 7, wherein the barrel includes a cylindrical outer surface, and wherein the outer tube includes a cylindrical inner surface, the outer surface of the barrel and the inner surface of the outer tube defining the annular space.

* * * * *